US005445666A

United States Patent [19]

Peschka et al.

[11] Patent Number: 5,445,666

[45] Date of Patent: Aug. 29, 1995

[54] METHOD FOR PRODUCING SMALL METAL BALLS APPROXIMATELY EQUAL IN DIAMETER

[75] Inventors: Walter Peschka, Sindelfingen; Constantin Carpetis, Wolfschlugen; Gottfried Schneider, Stuttgart, all of Germany

[73] Assignee: Deutsche Forschungsanstalt fuer Luft- und Raumfahrt e.V., Bonn, Germany

[21] Appl. No.: 169,966

[22] Filed: Dec. 14, 1993

[30] Foreign Application Priority Data

Dec. 17, 1992 [DE] Germany ..... 42 42 645.6

[51] Int. Cl.[6] ..... B29B 9/00; B22F 9/00

[52] U.S. Cl. ..... 75/335; 75/331; 75/338; 75/342

[58] Field of Search ..... 75/331, 335, 338, 342

[56] References Cited

U.S. PATENT DOCUMENTS

| | | | |
|---|---|---|---|
| 4,428,894 | 1/1984 | Bienevenu | 75/335 |
| 4,640,806 | 2/1987 | Duerig et al. | 75/335 |
| 4,671,906 | 6/1987 | Yasue et al. | 75/335 |
| 4,774,037 | 9/1988 | Hendricks | 75/335 |
| 5,171,360 | 12/1992 | Orme et al. | 75/331 |
| 5,183,493 | 2/1993 | Brandau et al. | 75/335 |
| 5,198,157 | 3/1993 | Bechet | 75/335 |
| 5,259,593 | 11/1993 | Orme et al. | 75/331 |
| 5,266,098 | 11/1993 | Chun et al. | 75/335 |

FOREIGN PATENT DOCUMENTS

| | | | |
|---|---|---|---|
| 3735787 | 3/1989 | Germany | B05B 17/06 |
| 4022648 | 1/1992 | Germany | B22F 9/06 |
| 0208407 | 8/1989 | Japan | 75/335 |
| 3162507 | 7/1991 | Japan | 75/335 |
| 1682039 | 10/1991 | U.S.S.R. | 75/335 |

*Primary Examiner*—Upendra Roy
*Attorney, Agent, or Firm*—Barry R. Lipsitz

[57] ABSTRACT

In order to develop a method for producing at least approximately ball-shaped metallic particles at least almost equal in diameter such that a greater yield of particles at least almost equal in diameter is achieved than in known methods, it is suggested that a continuous stream of liquid metal is acted on locally by compressional vibrations that thereby cross-sectional constrictions are formed in the stream at a distance from each other in longitudinal direction of the stream which lead to the dissection of the stream and that the segments of the dissected stream adopting a ball shape due to the surface tension of the liquid metal are cooled to solidify the liquid metal.

13 Claims, 2 Drawing Sheets

METHOD FOR PRODUCING SMALL METAL BALLS APPROXIMATELY EQUAL IN DIAMETER

BACKGROUND OF THE INVENTION

The invention relates to a method for producing at least approximately ball-shaped metallic particles at least almost equal in diameter.

Further, the invention concerns an apparatus for producing ball-shaped particles of this type with a melting device for producing liquid or molten metal.

Approximately ball-shaped metallic particles—these are often particles consisting of metal alloys—at least almost equal in diameter are required for a number of technical applications, in particular, in powder metallurgy or in the technology of regenerators for refrigerators. A number of methods for producing particles of this type from molten metal are known; for example, particles of liquid metal are produced by means of dissecting liquid metal above a gas stream flowing against the force of gravity, the particles then adopting a ball shape due to the surface tension of the liquid metal and solidifying. In another method, liquid metal is dropped onto a rotating plate. Due to the movement of the plate and the inertia of the dropped metal, the drops of liquid metal "roll" on the rotating plate towards the outside and are thereby cooled evenly on their surfaces until they solidify and are thereby brought into ball shape which, however, at the most, meets only minor demands.

Finally, it is known to produce metallic particles which are as ball-shaped as possible from the corresponding metal by catapulting drops of liquid metal from the cathode spot of an arc of an electrode rotating about its longitudinal axis.

All these methods, however, have the disadvantage in common, namely an extensive spreading of the diameter of the drop-shaped or, at the most, approximately ball-shaped metallic particles produced in the respective manner. In order to obtain particles almost equal in diameter with the known methods, ball-shaped particles having a diameter within a desired range must be sorted out by means of corresponding mechanisms from a batch of particles produced according to the respective method. The yield attained hereby is, however, relatively low depending on the requirement with respect to the width of the acceptable diameter range, and in many cases less than 5% of the batch of produced particles, which is expensive and enormously troublesome especially when considerable amounts of drop-shaped or approximately ball-shaped particles are required.

Therefore, the object of the invention is to develop a method of the type described at the beginning in which a greater yield of particles at least approximately equal in diameter can be achieved than in known methods.

SUMMARY OF THE INVENTION

This object is solved in accordance with the invention in that compressional vibrations act locally on a continuous stream of liquid metal, that cross-sectional constrictions are formed in the stream at a distance from each other and in longitudinal direction of the stream which result in the dissection of the stream, and that the segments of the dissected stream adopting a ball shape due to the surface tension of the liquid metal are cooled in order to solidify the liquid metal.

Due to the compressional vibrations acting locally on the stream, i.e. due to the stream being acted upon within an essentially stationary region past which the liquid metal flows, surface or capillary waves are excited at the surface of the stream; thus, cross-sectional constrictions are formed in the stream at a distance from each other in longitudinal direction of the stream, these constrictions being unstable and therefore leading to further constrictions until the stream is dissected. The at least approximately ball-shaped metallic particles produced in this manner have a far smaller width of dispersion than is achievable with known methods.

In order to perform the method according to the invention, the continuous stream of liquid metal is acted upon by compressional vibrations propagating either essentially radially or essentially axially to the direction of the stream, whereby the radial action in view of its capability of being localized, i.e. in view of its capability of being limited to an essentially stationary portion of the stream has proven to be advantageous.

In order to produce approximately ball-shaped metallic particles of a predetermined size with the claimed method, it is suggested according to the invention that the cross-section of the stream, the frequency of the compressional vibration as well as the velocity of flow of the liquid metal in the stream be selected as a function of the desired size of the particles to be produced. It is hereby advantageous to select the diameter of the stream slightly smaller than the desired particle diameter and when the stream is acted upon radially, to select the frequency of the compressional vibration acting on the stream in order of magnitude within the range of the quotient of velocity of flow and desired particle diameter.

When performing the method according to the invention, it is further expedient for the velocity of flow of the liquid metal in the stream to be selected as a function of the frequency of the compressional vibration acting on the stream and, therefore, the velocity of propagation of the capillary waves relative to the stream. If the velocity of flow is continually selected such that its velocity is high in comparison with the velocity of propagation of the capillary waves excited on the surface of the stream, then it is achieved according to the invention that the liquid metal flows through the cross-sectional constrictions forced on the stream by the compressional vibrations and these constrictions become unstable due to the drop in pressure resulting from the increased velocity of flow of the liquid metal in this area and dissection of the stream according to the invention results.

When compressional vibrations propagating essentially radially to the direction of the stream are used to form the cross-sectional constrictions in the stream, it is expedient for the stream to be acted upon by radial and equal-phase compressional vibrations from several directions. The ideal borderline case of this preferred method variation would mean that the stream is acted upon by compressional vibrations moving radially towards the stream and having wave fronts extending concentrically to the stream. In this case, the cross-sectional constrictions produced by the compressional vibrations would be rotationally symmetrical in relation to the longitudinal axis of the stream.

The method is preferably performed such that compressional vibrations are excited in a gas atmosphere surrounding the stream and then act on the stream. If great demands are placed on the purity of the metal, it is advisable to perform the method in an inert gas atmosphere.

According to an especially preferred method variation, the compressional vibrations are coupled onto a nozzle arrangement producing the stream and then act directly on the stream. In this manner, the stream of liquid metal can also exit into a vacuum, which could be desirable in certain cases.

The ball-shaped segments of liquid metal can fundamentally be cooled down in any manner for forming solid metal balls; it has, however, proven to be advantageous for the ball-shaped segments of liquid metal to be cooled down by free fall in a gas atmosphere. It has proven to be an even greater advantage to cool down the ball-shaped segments by means of a moved gas atmosphere, in particular, by means of free fall in a moved gas atmosphere, since the necessary space required for this is smaller than that necessary for free fall in a motionless gas atmosphere.

Instead of or in addition to the two preceding method variations, it is suggested that for accelerating the cooling and, if necessary, the solidification of the segments, to drop the same onto a plate rotating about its vertical axis. In this case, it has proven to be expedient for the segments rebounding from the rotating plate to be limited by a cover arranged above the rotating plate, in particular a stationary cover, to the region between the plate and the cover.

The further object of the invention is to develop an apparatus of the type described at the outset, with which it is possible to achieve smaller widths of dispersion of the diameter of the ball-shaped particles produceable with the apparatus than was possible previously, and which is especially applicable for performing the method according to the invention.

This additional object is solved according to the invention in that the apparatus comprises a nozzle arrangement for producing a stream of liquid metal as well as a device for generating compressional vibrations acting locally on the stream for forming cross-sectional constrictions in the stream at a distance from each other in longitudinal direction of the stream.

Although compressional vibrations generally spread out spherically, i.e. spread out in all directions, it would be possible, in order to generate compressional vibrations acting locally on the stream, to arrange the device either very close to the stream or to provide a transmitting medium for compressional vibrations, by means of which the compressional vibrations are brought to the stream and act on this stream within a limited, essentially stationary section. An advantageous embodiment of the apparatus according to the invention is, however, designed such that the nozzle arrangement has a nozzle opening arranged within a protective shield for compressional vibrations, the shield forming a channel for the stream and having an opening serving as coupling-in point for compressional vibrations to act locally on the stream, the vibrations propagating essentially radially to the direction of the stream.

In order to achieve cross-sectional constrictions in the stream which are as uniform as possible, i.e. rotationally symmetrical with reference to the longitudinal axis of the stream, it is expedient when several coupling-in points, in particular arranged concentrically to the direction of the stream, are provided for compressional vibrations through which equal-phase compressional vibrations propagating essentially radially to the direction of the stream act on this stream from several directions.

Furthermore, it is conceivable and advantageous for the device for generating the compressional vibrations to comprise several compressional vibration transmitters.

In order for the compressional vibrations propagating axially to the direction of the stream to be able to act on the stream of liquid metal, it is suggested to design the apparatus according to the invention such that the nozzle arrangement has a nozzle opening arranged within a wave guide forming a channel for the stream and that the device for generating compressional vibrations is arranged at a region of the wave guide on the nozzle side so as to be emissive in the direction of the stream and that the length of the wave guide open at its end opposite the nozzle arrangement, measured from the device up to this end, is a multiple of half the wave length of the compressional vibrations. In this manner, a standing wave portion of the generated compressional vibrations can be formed within the wave guide which acts locally on the stream, i.e. within the length of the wave guide defined above.

Fundamentally, it would also be conceivable to couple the compressional vibrations into the wave guide from the end of this wave guide opposite the nozzle arrangement and to design the area of the wave guide on the nozzle side as so-called fixed end, whereby the measurement of the wave guide defined above ought to be an uneven multiple of the fourth part of the wave length of the used compressional vibrations. In this embodiment of the apparatus according to the invention, the device for generating the compressional vibrations is to be arranged such that it does not obstruct the stream or the exiting stream segments flowing out of the wave guide.

The device for generating the compressional vibrations could be designed by means of a pressure chamber system which, for example, couples into the region of the wave guide on the nozzle side via small openings or could comprise a loudspeaker diaphragm or a piezo crystal.

Further, the apparatus can be designed such that the compressional vibrations generated by the device are transferable onto the stream via a gas atmosphere; it is, however, also conceivable and advantageous that when operations have to be done in a vacuum, that the device for generating the compressional vibrations is designed so as to interact with the nozzle arrangement such that the compressional vibrations are adapted to be coupled onto the nozzle arrangement and that the compressional vibration acts directly on the stream of liquid metal via the nozzle arrangement.

Further advantages, features and details of the invention are apparent from the following description as well as from the illustrated representation of three preferred embodiments of the apparatus according to the invention for producing ball-shaped metallic particles. In the drawings.

DESCRIPTION OF THE PREFERRED EMBODIMENTS

Figure 1:
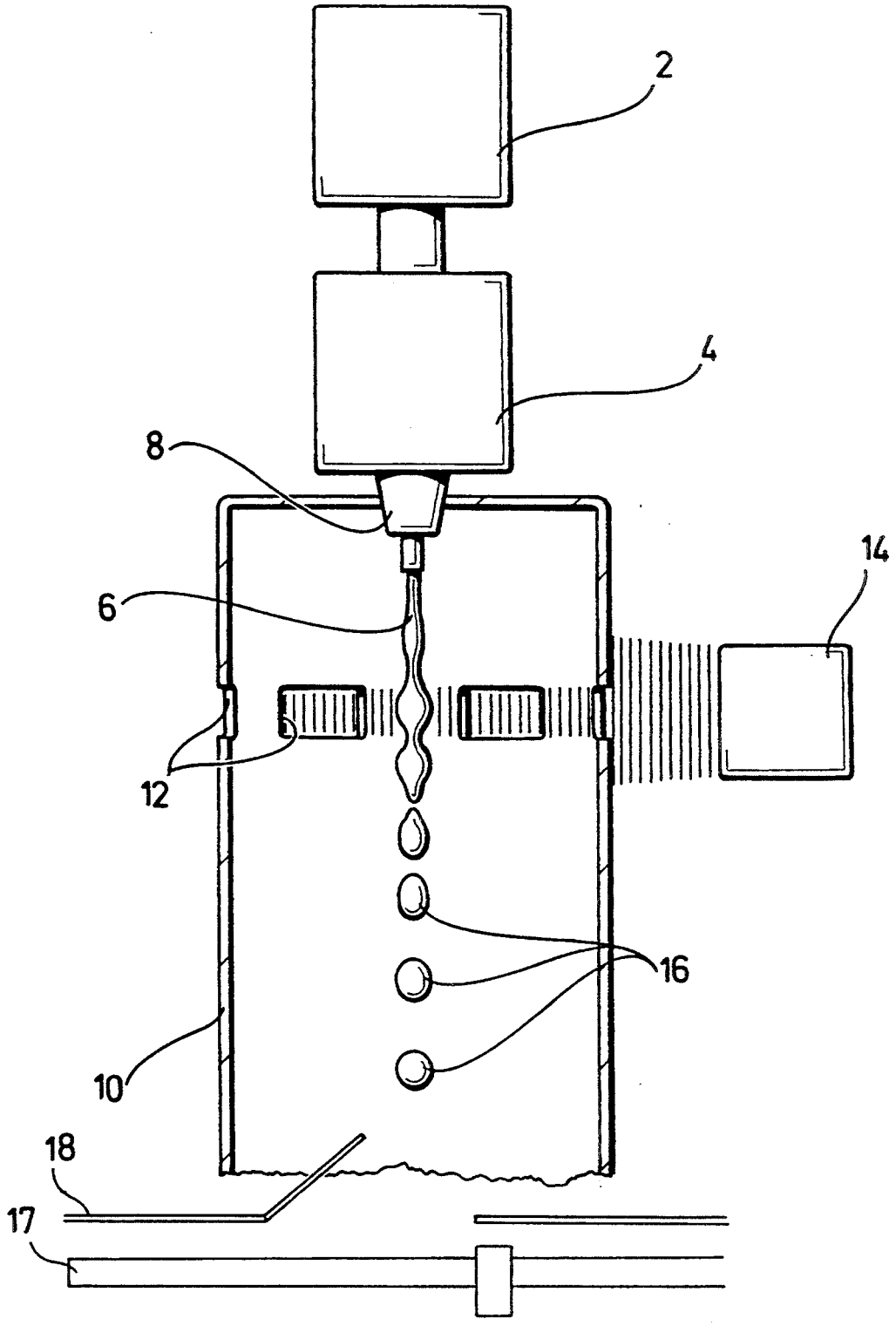
FIG. 1 is a first embodiment of the apparatus according to the invention with a device for generating compressional vibrations propagating radially to the direction of the stream.

As is apparent in detail from the schematic representation in FIG. 1, the apparatus according to the invention for producing ball-shaped metallic particles almost equal in diameter comprises a melting device 2 as well as a nozzle arrangement 4 connected with the melting device 2 for producing a stream of liquid metal 6. A nozzle 8 of the nozzle arrangement 4 is arranged so as to open within a tube-shaped protective shield 10 for compressional vibrations. The nozzle arrangement 4 and the nozzle 8 are arranged such that the stream of liquid metal flows downwards out of the nozzle 8 in a vertical direction. The protective shield 10 is arranged so as to extend in vertical direction coaxially to the direction of the stream and has several rectangular-shaped openings 12 serving as coupling-in points for coupling compressional vibrations propagating essentially radially to the direction of the stream. Several devices 14 for generating these compressional vibrations, of which only one is illustrated, are arranged radially to the direction of the stream so as to be emissive at the level of the rectangular-shaped openings 12. By means of the device 14, compressional vibrations of suitable frequency and amplitude are coupled into the interior of the protective shield 10 by means of a suitable medium, as in particular air, and act on the stream 6 of liquid metal whereby a modulation of the cross-section of the stream is achieved which leads to further stream constrictions until the stream is dissected. Due to the surface tension of the liquid metal, segments 16 of the dissected stream taking on a ball shape exit the protective shield 10 in free fall through the gas atmosphere surrounding them and are hereby "dropped" onto a plate 17 rotating about its vertical axis. In this respect, the segments 16 taking on a ball shape are cooled, whereby the liquid metal solidifies. By means of a cover 18 arranged above the plate 17, the segments 16 rebounding from the plate 17 are limited to the region between plate 17 and cover 18.

Figure 2:
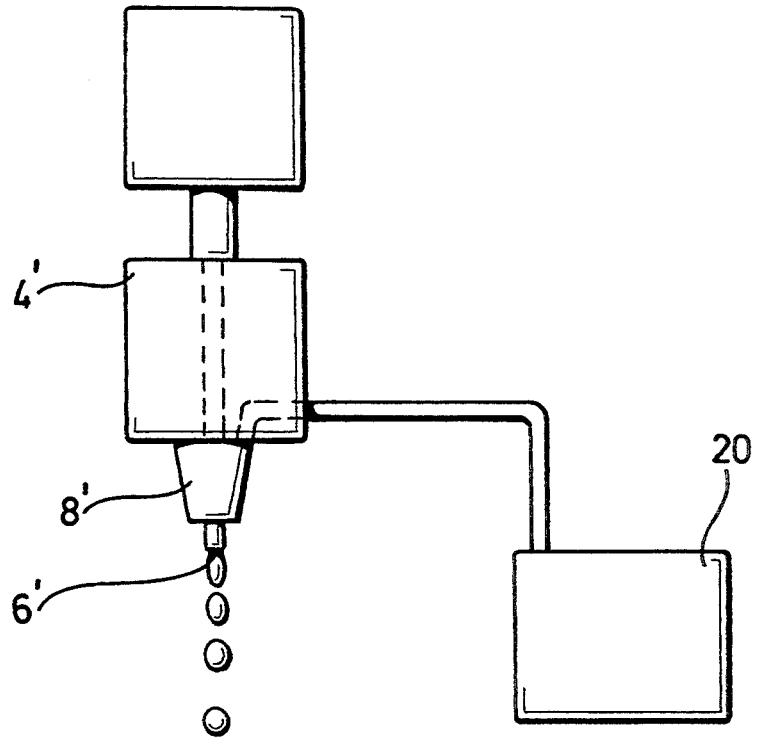
FIG. 2 is a second embodiment of the apparatus according to the invention in which the device for generating the compressional vibrations interacts with a nozzle arrangement of the apparatus and FIG. 3 is a third embodiment of the apparatus according to the invention with a device for generating compressional vibrations propagating axially to the direction of the stream.
Figure 3:
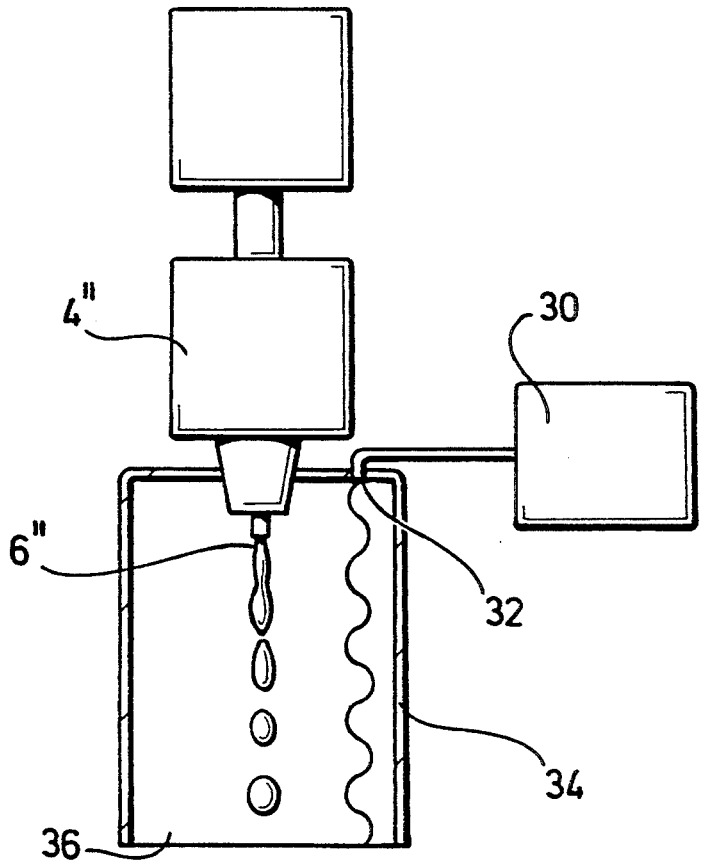

The embodiment of the apparatus according to the invention represented in FIG. 2 differs from the precedingly described embodiment in that a device 20 for generating the compressional vibrations is connected to the nozzle arrangement 4' such that the compressional vibrations generated by the device 20 are coupled onto the nozzle arrangement 4' where they are then transferred onto the nozzle 8' and then act directly on the stream 6' of liquid metal.

In this case, a device corresponding with the protective shield 10 is not necessarily required; due to the action on the stream 6' through the nozzle 8' it is possible to work in a vacuum instead of a gas atmosphere as in the embodiment described above.

A third embodiment of the apparatus according to the invention comprises a pressure chamber system 30 for generating compressional vibrations propagating axially to the direction of the stream. These compressional vibrations are coupled into a wave guide 34 in the direction of the stream through an opening 32 serving as coupling-in point, this wave guide having a cylinder-shaped design, whereby an end 36 of the cylinder opposite the nozzle arrangement 4'' is open. In order to form standing waves by means of the compressional vibrations propagating axially to the direction of the stream, the length of the wave guide 34 from the opening 32, where the compressional vibrations are coupled in, measured up to its open end 36 is a multiple of half the wave length of the coupled-in compressional vibration, whereby a standing wave portion acting on the stream 6'' is formed which leads to the dissection of the stream according to the invention.

What is claimed is:

1. A method for producing at least approximately ball-shaped metallic particles at least almost equal in diameter, comprising the steps of:

generating a continuous stream of liquid metal surrounded by a gas atmosphere;

exciting compressional vibrations in said gas atmosphere such that said compressional vibrations act locally on said stream of liquid metal, whereby cross-sectional constrictions are formed in said stream at a distance from each other in a longitudinal direction of said stream, said constrictions leading to the dissection of said stream into segments, said segments of said dissected stream adopting a ball shape due to the surface tension of said liquid metal; and cooling said segments in order to solidify said liquid metal.

2. The method according to claim 1, wherein said stream is acted upon by compressional vibrations propagating essentially radially to said longitudinal direction of said stream.

3. The method according to claim 1, wherein said stream is acted upon by compressional vibrations propagating essentially axially to said longitudinal direction of said stream.

4. The method according to claim 1, wherein the cross-section of the stream, the frequency of said compressional vibrations as well as the velocity of flow of said liquid metal in said stream are selected as a function of the desired size of the particles to be produced.

5. The method according to claim 1, wherein the velocity of flow of said liquid metal in said stream is selected as a function of the frequency of said compressional vibrations acting on said stream.

6. The method according to claim 1, wherein said ball-shaped segments of liquid metal are cooled down by means of free fall in a gas atmosphere.

7. The method according to claim 1, wherein said cooling and solidification of said segments are accelerated by dropping the same onto a plate rotating about its vertical axis.

8. The method according to claim 1, wherein said stream of liquid metal is generated by a nozzle arrangement having a nozzle opening arranged within a protective shield for compressional vibrations, said shield forming a channel for said stream and having an opening serving as a coupling-in point for compressional vibrations to act locally on said stream, said vibrations propagating essentially radially to the direction of said stream.

9. The method according to claim 1, wherein said stream of liquid metal is generated by a nozzle arrangement having a nozzle opening arranged within a wave guide forming a channel for said stream; and said compressional vibrations are generated by a device arranged at a region on the nozzle side of said wave guide so as to be emissive in the direction of said stream;

said wave guide being open at its end opposite the nozzle arrangement and having a length measured from the device up to said end opposite the nozzle arrangement which is a multiple of half of the wave length of said compressional vibrations.

10. The method according to claim 2, wherein the stream is acted upon from several directions by equal-phase compressional vibrations propagating essentially radially to said longitudinal direction of said stream.

11. The method according to claim 6 wherein said ball-shaped segments of liquid metal are cooled down by a moving gas atmosphere.

12. The method according to claim 7, wherein said segments rebounding from said rotating plate are limited by a cover arranged above said rotating plate to the region between said plate and said cover.

13. The method according to claim 8, wherein said stream is acted upon from several directions by equal-phase compressional vibrations propagating essentially radially to the direction of said stream from several coupling-in points provided in said protective shield.

* * * * *